US006942198B2

(12) United States Patent
Huang

(10) Patent No.: US 6,942,198 B2
(45) Date of Patent: Sep. 13, 2005

(54) LIFTER

(76) Inventor: Chin-Piao Huang, No. 40, Chishim Road, Tongshiao, Miaoli Hsien (TW)

( * ) Notice: Subject to any disclaimer, the term of this patent is extended or adjusted under 35 U.S.C. 154(b) by 104 days.

(21) Appl. No.: 10/720,270

(22) Filed: Nov. 25, 2003

(65) Prior Publication Data

US 2005/0133768 A1 Jun. 23, 2005

(51) Int. Cl.[7] ..... B66F 1/00
(52) U.S. Cl. ..... 254/387; 254/385
(58) Field of Search ..... 254/385, 387, 254/388, 389, 393, 332, 329, 334, 338, 394, 254/398; 52/123.1, 118, 121

(56) References Cited

U.S. PATENT DOCUMENTS 3,861,647 A * 1/1975 Fields ..... 254/4 R
3,891,184 A * 6/1975 Fields ..... 254/4 R
4,135,627 A * 1/1979 McInerney ..... 212/299
4,508,316 A * 4/1985 Millard ..... 254/4 R
4,600,348 A * 7/1986 Pettit ..... 414/11
4,616,225 A * 10/1986 Woudenberg ..... 340/908
4,620,693 A * 11/1986 Vialars et al. ..... 254/335
6,234,453 B1 * 5/2001 Block ..... 254/285
6,499,610 B2 * 12/2002 Spitsbergen ..... 212/179

* cited by examiner

*Primary Examiner*—Kathy Matecki
*Assistant Examiner*—Evan Langdon
(74) *Attorney, Agent, or Firm*—Rosenberg, Klein & Lee

(57) ABSTRACT

A lifter is constructed to include a hollow main upright, a frame pivoted to the main upright to carry a hand winch, a link coupled between the frame and the main upright, a hollow auxiliary upright axially movably mounted in the hollow main upright, a lifting upright axially movably mounted in the hollow auxiliary upright, two first pulley blocks coupled between the hand winch and the hollow auxiliary upright and adapted to lift the hollow auxiliary upright upon operation of the hand winch, and two second pulley blocks coupled between the hollow main upright and the lifting upright and adapted to lift the lifting upright upon operation of the hand winch after the hollow auxiliary upright has been extended out of the hollow main upright.

5 Claims, 3 Drawing Sheets

LIFTER

BACKGROUND OF THE INVENTION

1. Field of the Invention

The present invention relates to a lifter for lifting a heavy load and, more particularly, to such a lifter, which is safe and durable in use.

2. Description of the Related Art

When lifting weights in a narrow place where a tower host or crane is not workable, a lifter may be used. Various lifters have been disclosed. There is known a lifter, which is comprised of a lifting main unit, a motor, and a transmission gearbox. The lifting main unit comprises an outer tube, and a telescopic tube mounted in the outer tube. The telescopic tube is formed of three inner tubes that slide one inside another. Each inner tube has the top and bottom sides respectively mounted with a pulley. The gearbox is coupled to the motor and adapted to rotate a winch, causing the winch to roll up or let off a cable, which has one end fastened to the winch and the other end extended in proper order through the pulleys at the top and bottom sides of each inner tubes and then fixedly connected to the bottom side of the last inner tube. When starting the motor to turn the transmission gear of the gearbox forwards/backwards, the winch is driven to roll up/let off the cable, thereby causing the telescopic tube to be extended out of or received inside the main tube. This structure of lifter is not safe in use. If the cable broke during operation, the lifter becomes unworkable, and an accident may occur. Further, because notches are made in the main tube and the inner tubes for accommodating the pulleys. The structural strength of the tubes is weakened.

SUMMARY OF THE INVENTION

The present invention has been accomplished under the circumstances in view. It is one object of the present invention to provide a lifter, which can easily be operated to lift the load with less effort. It is another object of the present invention to provide a lifter, which has a simple structure. It is still another object of the present invention to provide a lifter, which is safe in use. It is still another object of the present invention to provide a lifter, which is strong and durable in use.

To achieve these and other objects of the present invention, the lifter comprises a hollow main upright, said hollow main upright having a top side and a bottom side; a frame pivoted to said hollow main upright; a link coupled between said hollow main upright and said frame; a winch carried on said frame; at least one hollow auxiliary upright axially movably mounted in said hollow main upright, said at least one hollow auxiliary upright each having a top side and a bottom side; a lifting upright axially movably mounted in said at least one hollow auxiliary upright; at least one first pulley respectively provided at the top side of said hollow main upright; at least one second pulley respectively provided at the top side of each said hollow auxiliary upright; at least one first cable, said at least one first cable each having a first end fixedly fastened to said winch and a second end extended through one said at least one first pulley and then extended into the inside of said hollow main upright and fixedly fastened to the bottom side of one said at least one hollow auxiliary upright and adapted to lift said at least one hollow auxiliary upright out of said hollow main upright upon operation of said winch; and at least one second cable respectively extended through said at least one second pulley and coupled between the top side of said hollow main upright and the bottom side of said lifting upright and adapted to lift said lifting upright upon operation of said winch after said at least one hollow auxiliary upright has been extended out of said hollow main upright.

DETAILED DESCRIPTION OF THE PREFERRED EMBODIMENT

Figure 1:
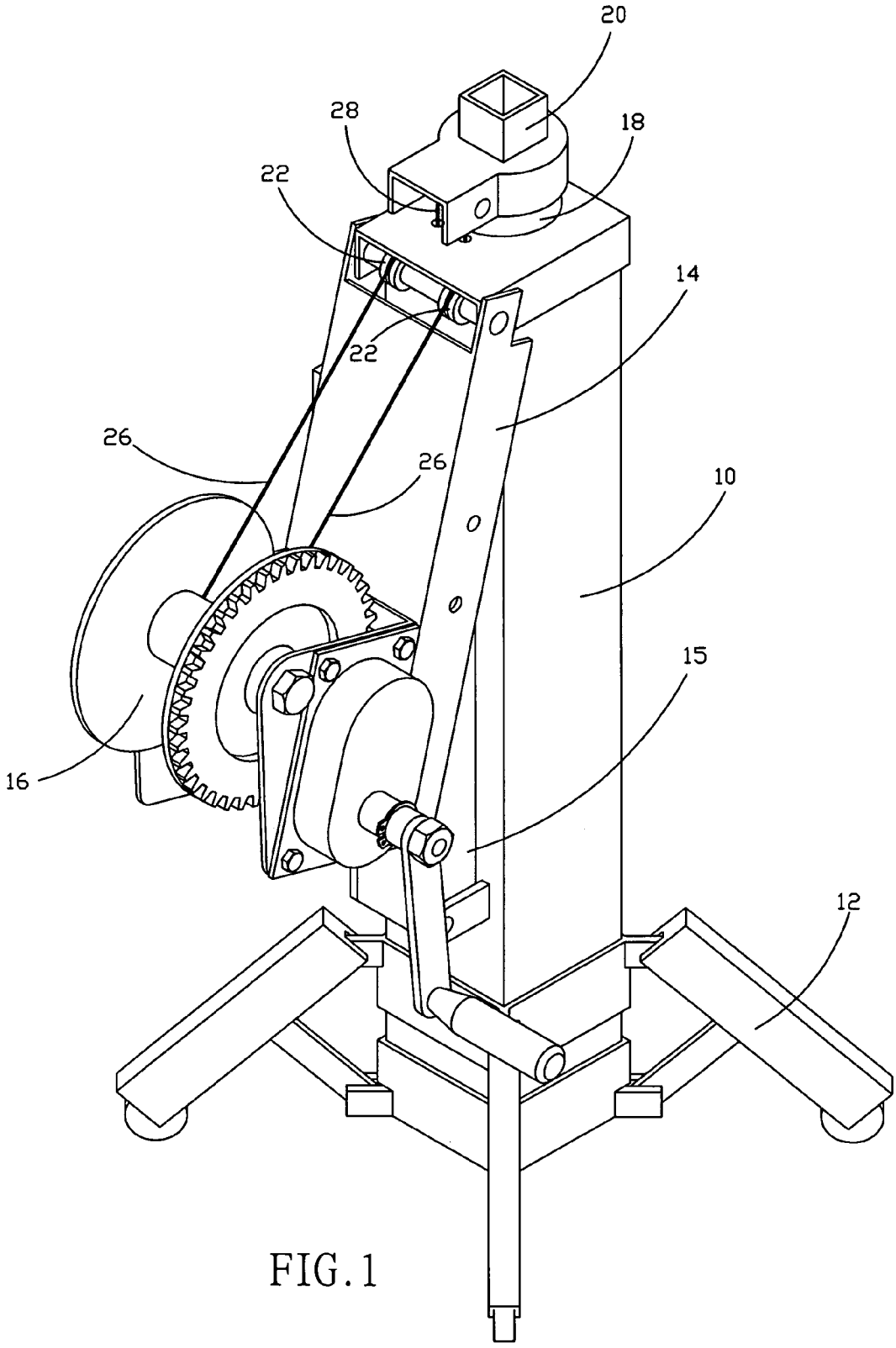
FIG. 1 is an elevational view of a lifter according to the present invention.
Figure 2:
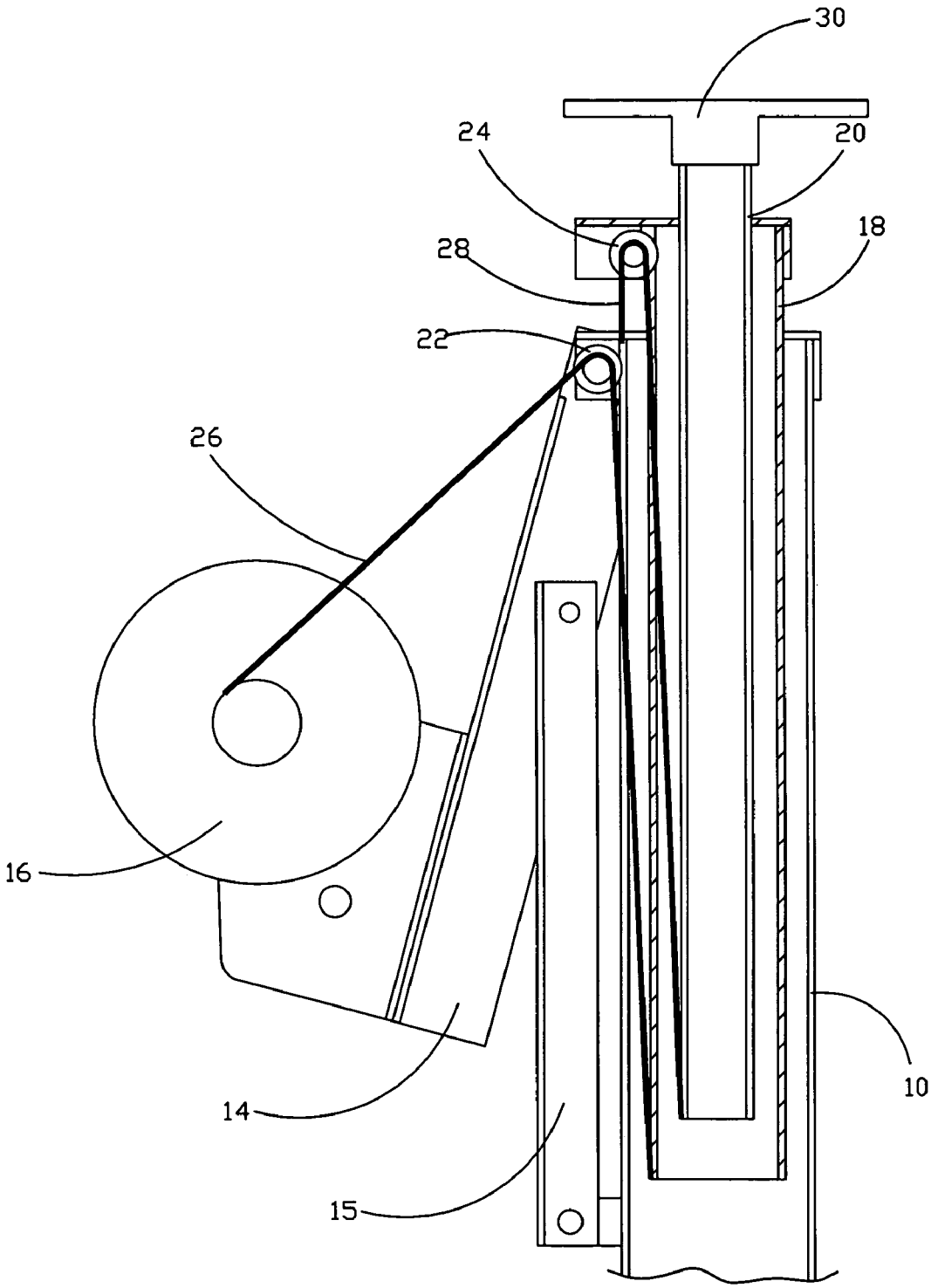
FIG. 2 is a sectional view of the lifter according to the present invention.

Referring to FIGS. 1 and 2, a lifter in accordance with the present invention is shown comprised of a wheeled carriage 12, a hollow main upright 10 mounted on the wheeled carriage 12 in vertical, a frame 14 pivoted to the hollow main upright 10, a hand winch 16 carried on the frame 14, a link 15 coupled between the bottom side of the hollow main upright 10 and a middle part of the frame 14, a hollow auxiliary upright 18 axially (vertically) movably mounted in the hollow main upright 10, a lifting upright 20 axially (vertically) movably mounted in the hollow auxiliary upright 18, a platform 30 fixedly provided at the top side of the lifting upright 20, a first pair of pulleys 22 bilaterally provided near the top of the hollow main upright 10 and arranged in parallel, a second pair of pulleys 24 bilaterally provided near the top of the hollow auxiliary upright 18 and arranged in parallel, two first cables 26 each having one end fixedly fastened to the winch 16 and the other end respectively extended through the first pulleys 22 and then turned downwards into the inside of the hollow main upright 10 and then fixedly fastened to the bottom side of the hollow auxiliary upright 18, and two second cables 28 each having one end fixedly fastened to the top side of the hollow main upright 10 and the other end respectively extended through the second pulleys 24 and then turned downwards into the inside of the hollow auxiliary upright 18 and then fixedly fastened to the bottom side of the lifting upright 20.

Figure 3:
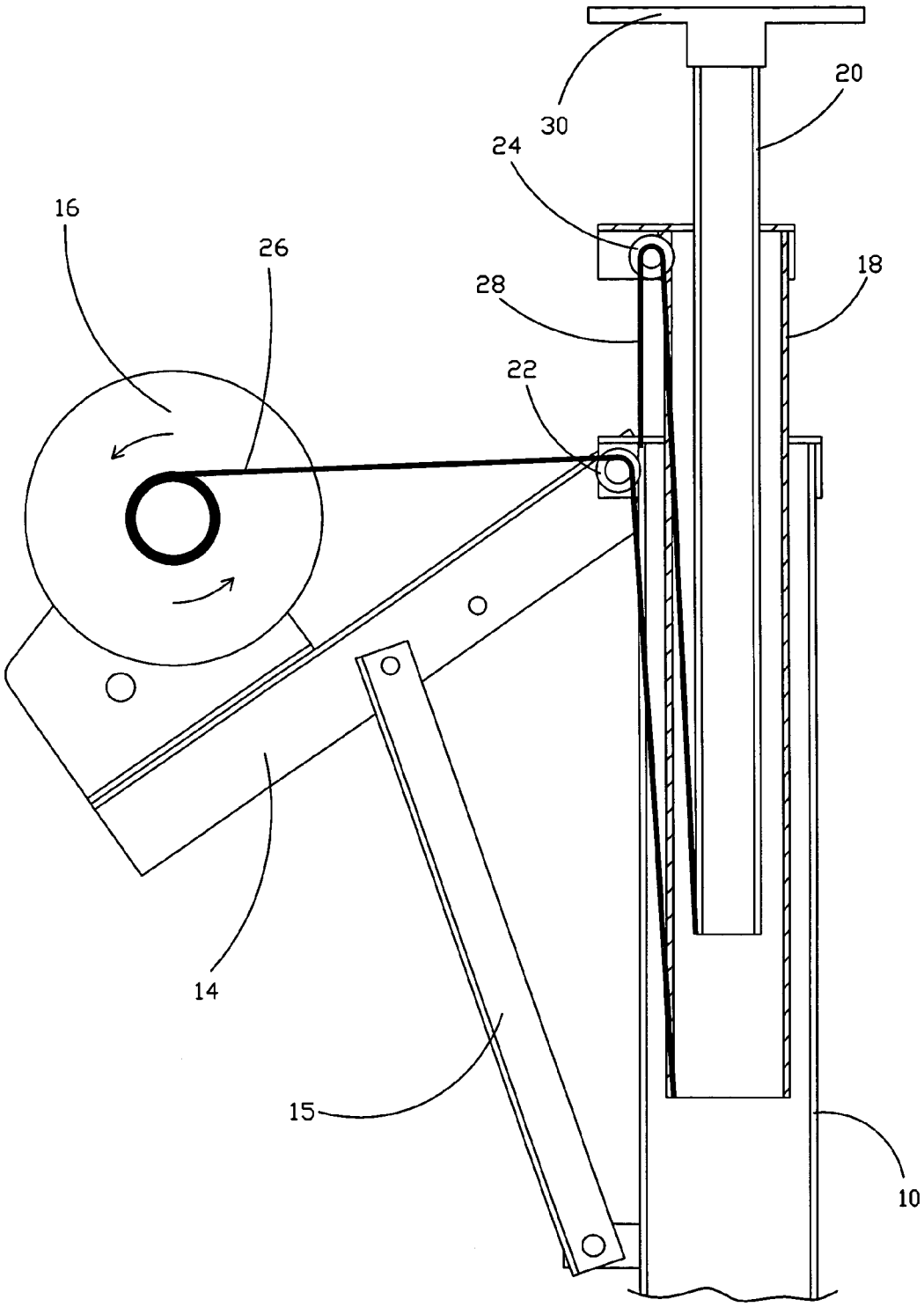
FIG. 3 is a schematic drawing showing the action of the lifter according to the present invention.

Referring also to FIG. 3, when wishing to lift a heavy load put on the platform 30, move the hand winch 16 with the hands to a relatively higher elevation (by means of the support of the link 15, the hand winch 16 can easily be turned with the coupling frame 14 to a relatively higher elevation), and then operate the hand winch 16 to wind up the first cables 26 and to further lift the hollow auxiliary upright 18. At this time, the second pulleys 24 are moved upwards with the hollow auxiliary upright 18. Because the second cables 28 are respectively extended through the second pulleys 24 and fixedly connected between the top side of the hollow main upright 10 and the bottom side of the lifting upright 20, upward movement of the second pulleys 24 with the hollow auxiliary upright 18 causes the second cables 28 to be driven to lift the lifting upright 20 and the heavy load on the platform 30.

The aforesaid first pulleys 22, second pulleys 24, first cables 26 and second cables 28 form two pulley blocks that function in the same way, i.e., one first pulley 22 forms with one second pulley 24, one first cable 26 and one second cable 28 a pulley block. Therefore, when one first cable 26 or second cable 28 broken suddenly during lifting, the lifter still keeps working without causing an accident.

In the aforesaid embodiment, the hollow main upright 10 is fixedly mounted on the wheeled carriage 12. By means of the wheeled carriage 12, the lifter can easily be moved from place to place. Alternatively, the hollow main upright 10 can be fixedly mounted on a fixed mount or the like. A hollow auxiliary sub-upright may be provided between the hollow auxiliary upright 18 and the lifting upright 20 to increase the lifting range of the lifter. In this case, the second cables 28 each have one end fixedly fastened to the top side of the hollow main upright 10 and the other end respectively extended through the second pulleys 24 and then turned downwards into the inside of the hollow auxiliary upright 18 and then fixedly fastened to the bottom side of the hollow auxiliary sub-upright, and two third cables are arranged each having one end fixedly fastened to the top side of the hollow auxiliary upright 18 and the other end extended through a respective third pulley at the top side of the auxiliary sub-upright and then turned downwards into the inside of the hollow auxiliary sub-upright and then fixedly fastened to the bottom side of the lifting upright 20. Further, safety means, for example, a safety lock may be used to prevent reverse rotation of the hand winch 16.

A prototype of lifter has been constructed with the features of FIGS. 1~3. The lifter functions smoothly to provide all of the features discussed earlier.

Although a particular embodiment of the invention has been described in detail for purposes of illustration, various modifications and enhancements may be made without departing from the spirit and scope of the invention.

What the invention claimed is:

1. A lifter comprising:

a hollow main upright, said hollow main upright having a top side and a bottom side;

a frame pivoted to said hollow main upright;

a link coupled between said hollow main upright and said frame;

a winch carried on said frame;

at least one hollow auxiliary upright axially movably mounted in said hollow main upright, said at least one hollow auxiliary upright each having a top side and a bottom side;

a lifting upright axially movably mounted in said at least one hollow auxiliary upright;

at least one first pulley respectively provided at the top side of said hollow main upright;

at least one second pulley respectively provided at the top side of each said hollow auxiliary upright;

at least one first cable, said at least one first cable each having a first end fixedly fastened to said winch and a second end extended through one said at least one first pulley and then extended into the inside of said hollow main upright and fixedly fastened to the bottom side of one said at least one hollow auxiliary upright and adapted to lift said at least one hollow auxiliary upright out of said hollow main upright upon operation of said winch; and at least one second cable respectively extended through said at least one second pulley and coupled between the top side of said hollow main upright and the bottom side of said lifting upright and adapted to lift said lifting upright upon operation of said winch after said at least one hollow auxiliary upright has been extended out of said hollow main upright.

2. The lifter as claimed in claim 1, wherein said hollow main upright is fixedly mounted on a wheeled carriage.

3. The lifter as claimed in claim 1, wherein said hollow main upright is fixedly mounted on a fixed platform.

4. The lifter as claimed in claim 1, wherein said winch is a hand winch.

5. The lifter as claimed in claim 1, further comprising safety lock means adapted to stop said winch from reverse rotation.

* * * * *